US009915890B2

(12) United States Patent
Shumiya

(10) Patent No.: US 9,915,890 B2
(45) Date of Patent: Mar. 13, 2018

(54) IMAGE FORMING APPARATUS CONFIGURED TO SCAN AND CONTROLLING METHOD THEREFOR

(71) Applicant: BROTHER KOGYO KABUSHIKI KAISHA, Nagoya-shi, Aichi-ken (JP)

(72) Inventor: Kazushi Shumiya, Konan (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/446,437

(22) Filed: Mar. 1, 2017

(65) Prior Publication Data

US 2017/0255123 A1 Sep. 7, 2017

(30) Foreign Application Priority Data

Mar. 3, 2016 (JP) ..... 2016-041133

(51) Int. Cl.
*G03G 15/00* (2006.01)
*G03G 15/043* (2006.01)

(52) U.S. Cl.
CPC ..... *G03G 15/043* (2013.01)

(58) Field of Classification Search
USPC ..... 399/1–4, 51, 177, 179, 220, 221
See application file for complete search history.

(56) References Cited

U.S. PATENT DOCUMENTS 7,956,882 B2 * 6/2011 Nakajima ..... B41J 2/473 347/234
9,400,444 B2 * 7/2016 Sato ..... G03G 15/043
2004/0037584 A1 2/2004 Takahashi et al.
2010/0296822 A1 * 11/2010 Takada ..... G03G 15/0131 399/9
2015/0002599 A1 * 1/2015 Kondo ..... G03G 15/04036 347/134

FOREIGN PATENT DOCUMENTS

JP 2003-200609 A 7/2003
JP 2004-354626 A 12/2004
JP 2005-055591 A 3/2005
JP 2011-224999 A 11/2011

* cited by examiner

*Primary Examiner* — Hoan Tran
(74) *Attorney, Agent, or Firm* — Merchant & Gould P.C.

(57) ABSTRACT

An image forming apparatus includes a polygon mirror having a first mirror surface and a controller. The controller is configured to: acquire a detection interval corresponding to one rotation of a polygon mirror; start scanning exposure with a first beam deflected by the first mirror surface, in response to elapse of a first time period after a detection signal has been detected; and start scanning exposure with a second beam deflected by the first mirror surface, in response to elapse of a second time period after the detection signal has been detected. The second time period is calculated based on the detection interval.

12 Claims, 10 Drawing Sheets

IMAGE FORMING APPARATUS CONFIGURED TO SCAN AND CONTROLLING METHOD THEREFOR

CROSS REFERENCE TO RELATED APPLICATION

This application claims priority from Japanese Patent Application No. 2016-041133 filed Mar. 3, 2016. The entire content of the priority application is incorporated herein by reference.

TECHNICAL FIELD

The present disclosure relates to an image forming apparatus provided with an optical scanning device that scans and exposes a photosensitive body with a polygon mirror and a control method for the optical scanning device.

BACKGROUND

There is known an image forming apparatus provided with an optical scanning device having first and second light sources, a polygon mirror that deflects first and second beams emitted from the respective first and second light sources, a first scanning optical system disposed on one side of the polygon mirror and forms the image of the first beam on a first photosensitive body, and a second scanning optical system disposed on the other side of the polygon mirror and forms the image of the second beam on a second photosensitive body. In the disclosed technology, an optical sensor for detecting the first beam is provided on the upstream side of the first scanning optical system in the scanning direction, while no optical sensor is provided on the second scanning optical system.

SUMMARY

Thus, in the disclosed technology, scanning exposure by the first beam is started after a predetermined first beam writing time after detection of the first beam using one optical sensor, and scanning exposure by the second beam is started after a predetermined second beam writing time after detection of the first beam. Further, in this technology, considering an error in surface division accuracy of the polygon mirror, the second beam writing time is changed on the basis of a result of measuring the interval of time at which the first beam is detected using the optical sensor, whereby the positions of images formed by the respective first and second beams in the width direction of a paper sheet are aligned.

However, in the above conventional technology, when the rotation speed of a polygon motor is fluctuated, the time at which the first beam is detected using the optical sensor is influenced by the fluctuation in the rotation speed, with the result that second beam writing timing may be inaccurate.

The object of the present disclosure is therefore to perform the writing of the second beam at an appropriate timing even when the rotation speed of the polygon motor is fluctuated.

According to one aspect, the disclosure provides an image forming apparatus including a first light source, a second light source, a polygon mirror, a motor, a first scanning optical system, an optical sensor, a second scanning optical system, and a controller. The first light source is configured to emit a first beam. The second light source is configured to emit a second beam. The polygon mirror is configured to deflect the first beam and the second beam and having a first mirror surface. The motor is configured to rotate the polygon mirror about a rotation axis. The first scanning optical system is configured to focus the first beam deflected by the polygon mirror on a first photosensitive body. The first scanning optical system defines a scanning direction. The optical sensor is disposed upstream of the first scanning optical system in the scanning direction and configured to detect the first beam deflected by the polygon mirror to output a detection signal in response to the detection. The second scanning optical system is disposed opposite to the first scanning optical system with respect to the rotation axis and configured to focus the second beam deflected by the polygon mirror on a second photosensitive body. The controller is configured to perform: acquiring a detection interval of the detection signal during which the polygon mirror makes one rotation; in response to elapse of a first time period after the detection signal has been detected, starting scanning exposure with the first beam deflected by the first mirror surface; and in response to elapse of a second time period after the detection signal has been detected, starting scanning exposure with the second beam deflected by the first mirror surface, the second time period being calculated based on the detection interval.

According to another aspect, the disclosure provides a method for controlling an image forming apparatus that includes a first light source, a second light source, a polygon mirror, a motor, a first scanning optical system, an optical sensor, and a second scanning optical system. The first light source is configured to emit a first beam. The second light source is configured to emit a second beam. The polygon mirror is configured to deflect the first beam and the second beam and having a first mirror surface. The motor is configured to rotate the polygon mirror about a rotation axis. The first scanning optical system is configured to focus the first beam deflected by the polygon mirror on a first photosensitive body. The first scanning optical system defines a scanning direction. The optical sensor is disposed upstream of the first scanning optical system in the scanning direction and configured to detect the first beam deflected by the polygon mirror to output a detection signal in response to the detection. The second scanning optical system is disposed opposite to the first scanning optical system with respect to the rotation axis and configured to focus the second beam deflected by the polygon mirror on a second photosensitive body. The method includes: acquiring a detection interval of the detection signal during which the polygon mirror makes one rotation; in response to elapse of a first time period after the detection signal has been detected, starting scanning exposure with the first beam deflected by the first mirror surface; and in response to elapse of a second time period after the detection signal has been detected, starting scanning exposure with the second beam deflected by the first mirror surface, the second time period being calculated based on the detection interval.

BRIEF DESCRIPTION OF THE DRAWINGS

The particular features and advantages of the disclosure will become apparent from the following description taken in connection with the accompanying drawings, in which.

DETAILED DESCRIPTION

An embodiment of the present disclosure will be described in detail below by appropriately referring to the accompanying drawings. The entire configuration of a color printer 200 as an example of an image forming apparatus will be described first, followed by details on characteristic parts of the present disclosure.

Figure 1:
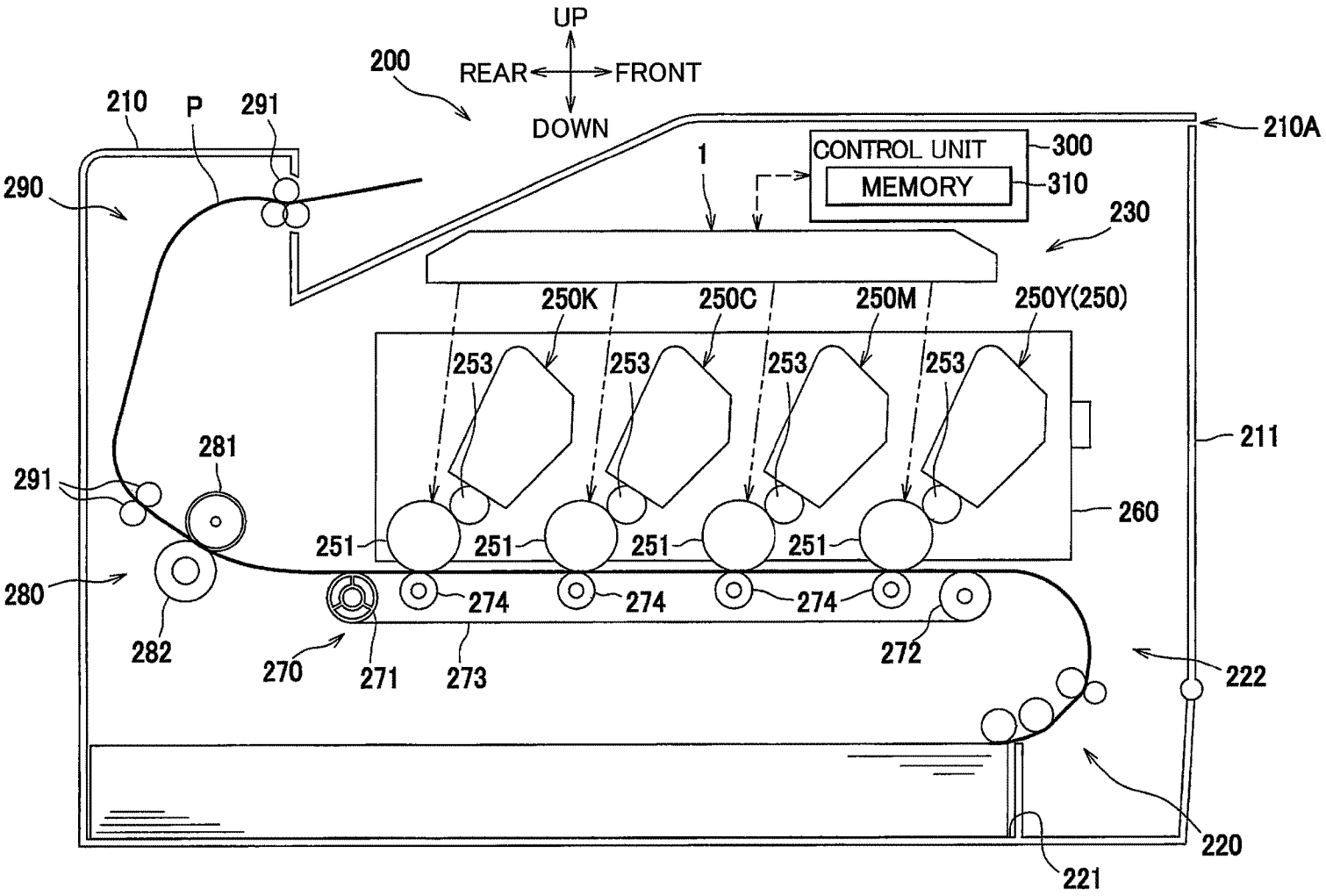
FIG. 1 is a view of a color printer according to an embodiment.

Hereinafter, when referring to the direction of a color printer 200, the right side of the paper surface of FIG. 1 is defined as "front side", the left side of the paper surface is defined as "rear side", the far side of the paper surface is defined as "right side", and the near side of the paper surface is defined as "left side". Further, the up-down direction with respect to the paper surface is defined as "up-down direction".

As illustrated in FIG. 1, the color printer 200 has inside a main body casing 210 thereof, a sheet supply unit 220 that supplies a paper sheet P, an image forming unit 230 that forms an image on the paper sheet P supplied, a sheet discharge unit 290 that discharges the image-formed paper sheet P, and a control unit 300 as an example of a controller.

The sheet supply unit 220 has a sheet supply tray 221 that stores therein the paper sheet P and a sheet conveying mechanism 222 that conveys the paper sheet P from the sheet supply tray 221 to the image forming unit 230.

The image forming unit 230 has a scanner unit 1 as an example of an optical scanning device, four process cartridges 250, a holder 260, a transfer unit 270, and a fixing device 280.

The scanner unit 1 exposes the surfaces of a plurality of photosensitive drums 251 and is provided at an upper portion inside the main body casing 210. Details of the scanner unit 1 and the control unit 300 that controls the scanner unit 1 will be described later.

The process cartridges 250 are arranged in the front-rear direction above the sheet supply unit 220 and each provided with the photosensitive drum 251 as an example of a photosensitive body, an unillustrated known charger, a developing roller 253, and a toner chamber. Toners of black, cyan, magenta, and yellow colors are stored in the respective process cartridges 250. When a process cartridge 250 or photosensitive drum 251 corresponding to a specific toner color is referred to in the present specification and drawings, "K" (black), "C" (cyan), "Y" (yellow), and "M" (magenta) are assigned thereto.

The holder 260 integrally holds the four process cartridges 250 and is configured to be movable in the front-rear direction through an opening part 210A formed by opening a front cover 211 disposed on the front surface of the main body casing 210.

The transfer unit 270 is provided between the sheet supply unit 220 and the four process cartridges 250 and has a driving roller 271, a driven roller 272, a conveying belt 273, and four transfer rollers 274.

The driving roller 271 and the driven roller 272 are disposed in parallel, spaced apart from each other in the front-rear direction. The conveying belt 273, which is an endless belt, is stretched between the driving roller 271 and the driven roller 272. Further, the four transfer rollers 274 are disposed inside the conveying belt 273 so as to be opposed to the respective photosensitive drums 251. The transfer rollers 274 hold the conveying belt 273 between themselves and the photosensitive drums 251.

The fixing device 280 is disposed rearward of the four process cartridges 250 and the transfer unit 270 and has a heating roller 281 and a pressure roller 282 confronting the heating roller 281 so as to press the heating roller 281.

In the thus configured image forming unit 230, the surface of each of the photosensitive drums 251 is uniformly charged by the charger and then exposed to the scanner unit 1. As a result, an electrostatic latent image based on image data is formed on each of the photosensitive drums 251. Thereafter, the toner in the toner chamber is supplied to the electrostatic latent image on each of the photosensitive drums 251 by the developing roller 253, whereby a toner image is carried on each of the photosensitive drum 251.

Then, the paper sheet P supplied on the conveying belt 273 passes between the photosensitive drums 251 and the transfer rollers 274, whereby the toner image formed on each of the photosensitive drums 251 is transferred onto the paper sheet P. Then, the toner image is thermally fixed onto the paper sheet P by the fixing device 280.

The sheet discharge unit 290 has a plurality of conveying rollers 291 that convey the paper sheet P. The paper sheet P onto which the toner image has been transferred and thermally fixed is conveyed by the conveying rollers 291 and discharged outside the main body casing 210.

The following describes in detail a configuration of the scanner unit 1. Hereinafter, the direction that deflects laser lights LY, LM, LC, and LK is defined as "main scanning direction". Further, "sub-scanning direction" is the direction perpendicular to the "main scanning direction" on the surface of the photosensitive drum 251, which is an image plane.

Figure 2:
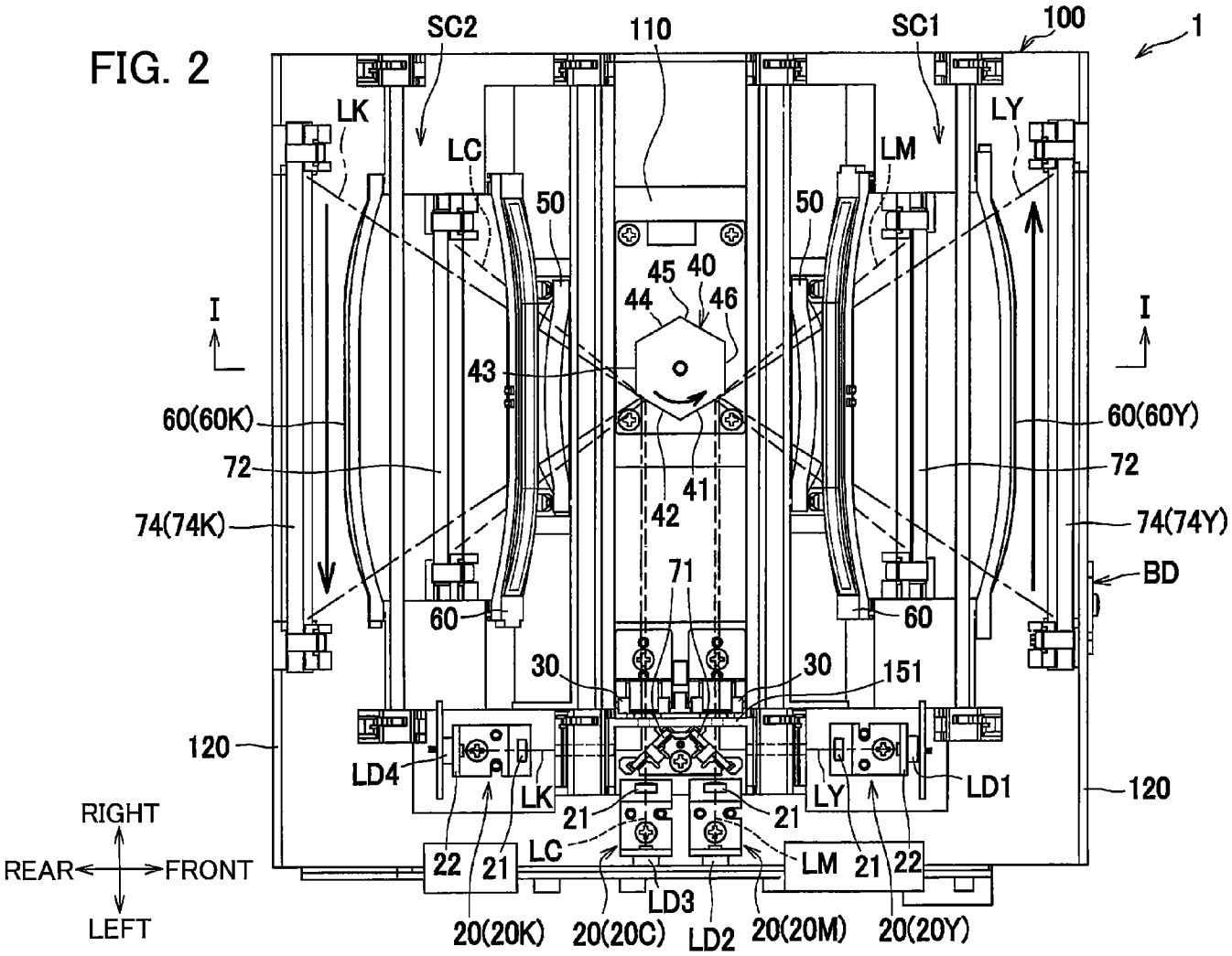
FIG. 2 is a plan view of a scanner unit according to the embodiment.
Figure 3:
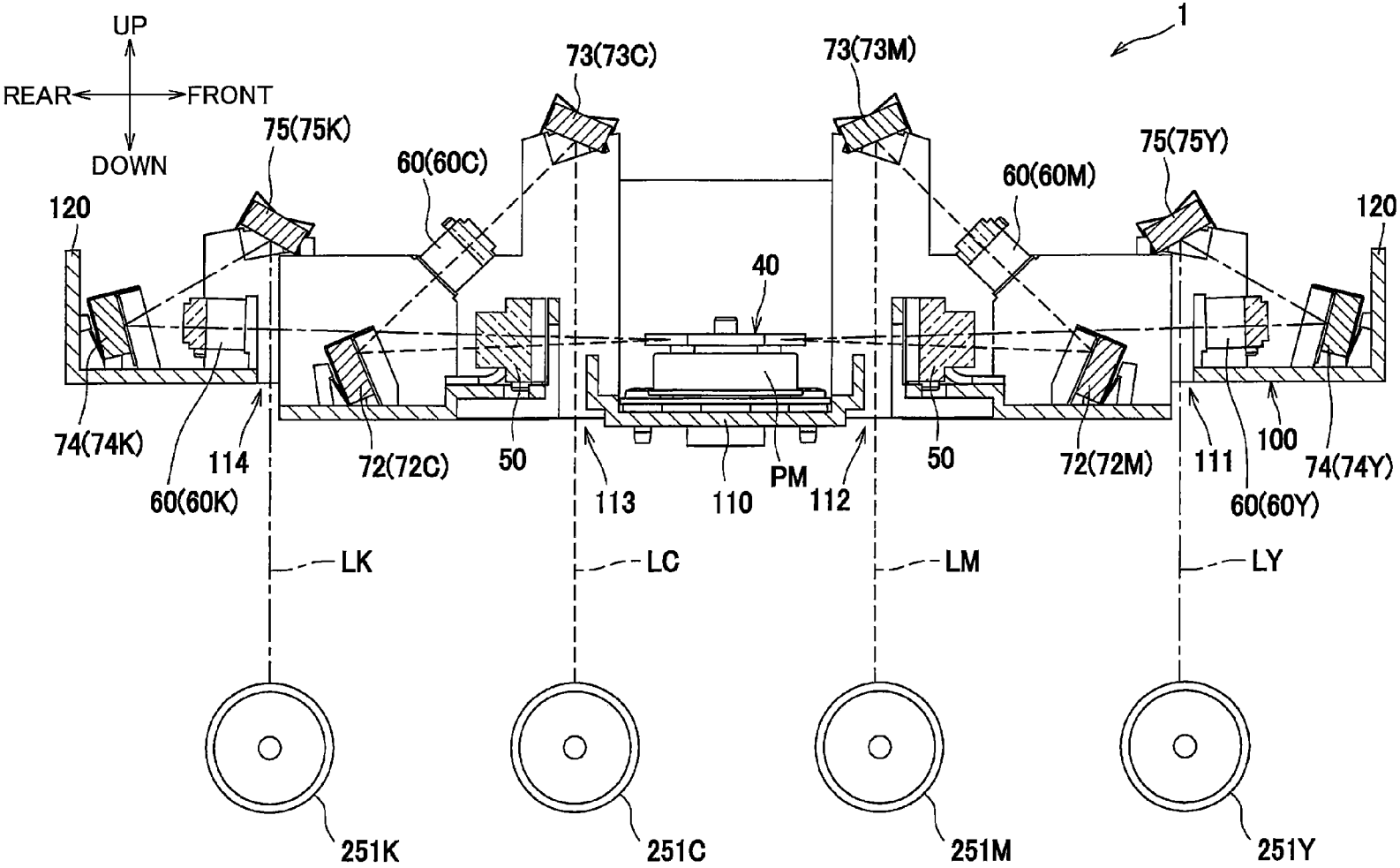
FIG. 3 is a cross-sectional view taken along line I-I in FIG. 2 according to the embodiment.

As illustrated in FIGS. 2 and 3, the scanner unit 1 has one casing 100, four light source devices 20 (20Y, 20M, 20C, 20K), two reflecting mirrors 71, two first cylindrical lenses 30, a polygon mirror 40, a first scanning optical system SC1 disposed frontward of the polygon mirror 40, and a second scanning optical system SC2 disposed rearward of the polygon mirror 40. That is, the second scanning optical system SC2 is disposed opposite the first scanning optical system SC1 with respect to the rotation axis of the polygon mirror 40. In other words, the second scanning optical system SC2 is disposed at a position rotated from the first scanning optical system SC1 by 180° (degrees) to the downstream side in the rotation direction of the polygon mirror 40.

The four light source devices 20Y, 20M, 20C, and 20K emit laser lights LY, LM, LC, and LK, respectively, and are provided so as to correspond to the four photosensitive drums 251Y, 251M, 251C, and 251K scanned and exposed by the scanner unit 1. The light source devices 20M and 20C are arranged side by side in the front-rear direction and configured to emit the laser lights LM and LC, respectively, in the left-right direction. The light source devices 20Y and 20K are arranged so as to face each other in the front-rear direction. The laser lights LY and LK emitted respectively from the light source devices 20Y and 20K cross substantially perpendicular to the laser lights LM and LC, which are emitted from the respective light source devices 20M and 20C.

The light source devices 20Y to 20K each mainly have a semiconductor laser device (LD1 to LD4), a coupling lens 21, and a frame 22. The semiconductor laser devices LD1 and LD2 disposed frontward of the rotation axis of the polygon mirror 40 correspond to first light sources, and semiconductor laser devices LD3 and LD4 disposed rearward of the rotation axis of the polygon mirror 40 correspond to second light sources. Hereinafter, for descriptive convenience, the semiconductor laser devices LD1 and LD2 as the first light sources are referred to also as "first semiconductor laser devices LD1 and LD2", and semiconductor laser devices LD3 and LD4 as the second light sources are referred to also as "second semiconductor laser devices LD3 and LD4". Further, the laser lights LY and LM emitted from the respective first semiconductor laser devices LD1 and LD2 are referred to also as "first beams LY and LM", and laser lights LC and LK respectively emitted from the second semiconductor laser devices LD3 and LD4 are referred to also as "second beams LC and LK".

The coupling lenses 21 are lenses that convert the laser lights LY to LK diverged and emitted from the respective semiconductor laser devices LD1 to LD4 into luminous fluxes. In the present disclosure, the luminous fluxes obtained by conversion using the coupling lenses 21 may be parallel light, convergent light, or divergent light.

The reflecting mirror 71 is a member that reflects or deflects the laser light LY from the light source device 20Y or laser light LK from the light source device 20K toward the polygon mirror 40 and is disposed between the light source devices 20M, 20C and the polygon mirror 40. The laser light LM from the light source device 20M and the laser light LC from the light source device 20C each pass above the reflecting mirror 71 and enter the polygon mirror 40.

The first cylindrical lens 30 is a lens that refracts the laser lights LM and LY or laser lights LC and LK and converges them in the sub-scanning direction to form the images thereof on the mirror surfaces 41 to 46 of the polygon mirror 40 in a linear shape elongated in the main scanning direction, thereby correcting the face tangle error of the polygon mirror 40. The first cylindrical lens 30 is disposed between the reflecting mirror 70 and the polygon mirror 40.

A wall 151 of the casing 100 is provided between the reflecting mirror 71 and the first cylindrical lens 30, and a plurality of apertures (see dashed line) are formed in the wall 151. The apertures formed in the wall 151 define the width of each of the laser lights LY to LK passing therethrough in the main scanning direction and sub-scanning direction.

The polygon mirror 40 has six mirror surfaces 41 to 46 provided at equal distances from the rotation axis thereof. The polygon mirror 40 is fixed to a rotor part of a polygon motor PM. The polygon mirror 40 is driven by the polygon motor PM, and the mirror surfaces 41 to 46 thereof are rotated about the rotation axis, whereby the laser lights LY to LK that have passed through the first cylindrical lens 30 are reflected and deflected by the mirror surfaces 41 to 46 in the main scanning direction. More specifically, the polygon mirror 40 deflects the first beams LY and LM emitted from the respective semiconductor laser devices LD1 and LD2 toward the first scanning optical system SC1 and deflects the second beams LC and LK emitted from the respective semiconductor laser devices LD3 and LD4 toward the second scanning optical system SC2. The polygon mirror 40 is disposed at substantially the center of the casing 100 so as to confront the light source devices 20M and 20C in the left-right direction. Hereinafter, a predetermined mirror surface of the polygon mirror 40 is referred to also as "first mirror surface 41", and mirror surfaces sequentially arranged on the upstream side in the rotation direction of the polygon mirror 40 are referred to also as "second mirror surface 42", "third mirror surface 43", "fourth mirror surface 44", "fifth mirror surface 45", and "sixth mirror surface 46".

The first scanning optical system SC1 is an optical system that forms the images of the first beams LY and LM deflected by the polygon mirror 40 on the respective photosensitive drums 251Y and 251M as an example of first photosensitive bodies. The first scanning optical system SC1 has one fθ lens 50, two second cylindrical lenses 60 (60Y, 60M) and a plurality of reflecting mirrors 72 to 75. The second scanning optical system SC2 is an optical system that forms the images of the second beams LC and LK deflected by the polygon mirror 40 on the respective photosensitive drums 251C and 251K as an example of second photosensitive bodies. The second scanning optical system SC2 has one fθ lens 50, two second cylindrical lenses 60 (60C, 60K) and a plurality of reflecting mirrors 72 to 75. The functions of components constituting the first scanning optical system SC1 and those of components constituting the second scanning optical system SC2 are substantially the same and thus will be collectively described below.

The fθ lens 50 converges the laser lights LY to LK, which is moved at an equal angular speed by the polygon mirror 40, on the surface of the photosensitive drum 251. Accordingly, the laser lights LY to LK scan the surface of the photosensitive drum 251 at an equal speed in the main scan direction. In the present embodiment, two fθ lenses 50 are provided frontward and backward of the polygon mirror 40, respectively.

The second cylindrical lens 60 is a lens that refracts the laser lights LY to LK and converges them in the sub-scanning direction to form the images thereof on the surface of the photosensitive drum 251, thereby correcting the face tangle error of the polygon mirror 40. In the present embodiment, four second cylindrical lenses 60 (60Y to 60K) are provided so as to correspond to the respective four light source devices 20Y to 20K.

The second cylindrical lenses 60M and 60C through which the respective laser lights LM and LC pass are each disposed above the fθ lens 50. The second cylindrical lenses 60Y and 60K through which the respective laser lights LY and LK pass are each disposed between the fθ lens 50 and a side wall 120 of the casing 100 so as to be confront the side wall 120.

The reflecting mirrors 72 to 75 are members that reflect the laser lights LY to LK and are each formed by, e.g., depositing a material having high reflectance, such as aluminum, onto the surface of a glass plate.

The reflecting mirrors 72 (72M, 72C) are disposed between the fθ lens 50 and the second cylindrical lens 60Y and between the fθ lens 50 and the second cylindrical lens 60K, respectively. The reflecting mirrors 72 reflect the laser lights LM and LC that have passed through the fθ lenses 50 toward the second cylindrical lenses 60M and 60C, respectively. The reflecting mirrors 73 (73M, 73C) are disposed above the fθ lenses 50 and reflect the laser lights LM and LC, which have passed through the second cylindrical lenses 60M and 60C, toward the surfaces of the photosensitive drums 251M and 251C, respectively.

The reflecting mirrors 74 (74Y, 74K) that extends along the side walls 120 are disposed between the second cylindrical lens 60Y and the side wall 120 of the casing 100 and between the second cylindrical lens 60K and side wall 120, respectively. The reflecting mirrors 74 reflect the laser lights LY and LK that have passed through the second cylindrical lenses 60Y and 60K, respectively toward the reflecting mirrors 75. The reflecting mirrors 75 (75Y, 75K) are disposed above the second cylindrical lenses 60Y and 60K, respectively, and reflect the laser lights LY and LK reflected by the reflecting mirrors 74 toward the surfaces of the photosensitive drums 251Y and 251K, respectively.

With the above configuration, as illustrated in FIG. 2, the laser lights LM and LC emitted from the respective light source devices 20M and 20C pass through the first cylindrical lens 30 and are then deflected by the polygon mirror 40 in the main scanning direction. Further, the laser lights LY and LK emitted from the respective light source devices 20Y and 20K are reflected by the respective reflecting mirrors 71 to be directed toward the polygon mirror 40, then pass through the respective first cylindrical lenses 30, and are deflected by the polygon mirror 40 in the main scanning direction.

As illustrated in FIG. 3, the laser lights LM and LC deflected by the polygon mirror 40 pass through the respective fθ lenses 50, reflected by the respective reflecting mirrors 72, pass through the respective second cylindrical lenses 60, and then reflected by the respective reflecting mirrors 73 to scan the exposed surfaces of the respective photosensitive drums 251. The laser lights LY and LK deflected by the polygon mirror 40 pass through the respective fθ lenses 50 and respective second cylindrical lenses 60, reflected by the respective reflecting mirrors 74, and then reflected by the respective reflecting mirrors 75 to scan the exposed surfaces of the respective photosensitive drums 251.

In other words, as illustrated in FIG. 2, the first beams LY and LM emitted from the respective light source devices 20Y and 20M for yellow and magenta are reflected toward the first scanning optical system SC1 by one mirror surface that is sequentially moved to the obliquely left front side (position irradiated with the first beams LY and LM) of the polygon mirror 40. The second beams LC and LK emitted from the respective light source devices 20C and 20K for cyan and black are reflected toward the second scanning optical system SC2 by one mirror surface that is sequentially moved to the obliquely left rear side (position irradiated with the second beams LC and LK) of the polygon mirror 40.

One writing sensor BD as an example of an optical sensor is provided on the upstream side of the first scanning optical system SC1 in the scanning direction of the first beam LY.

Figure 4:
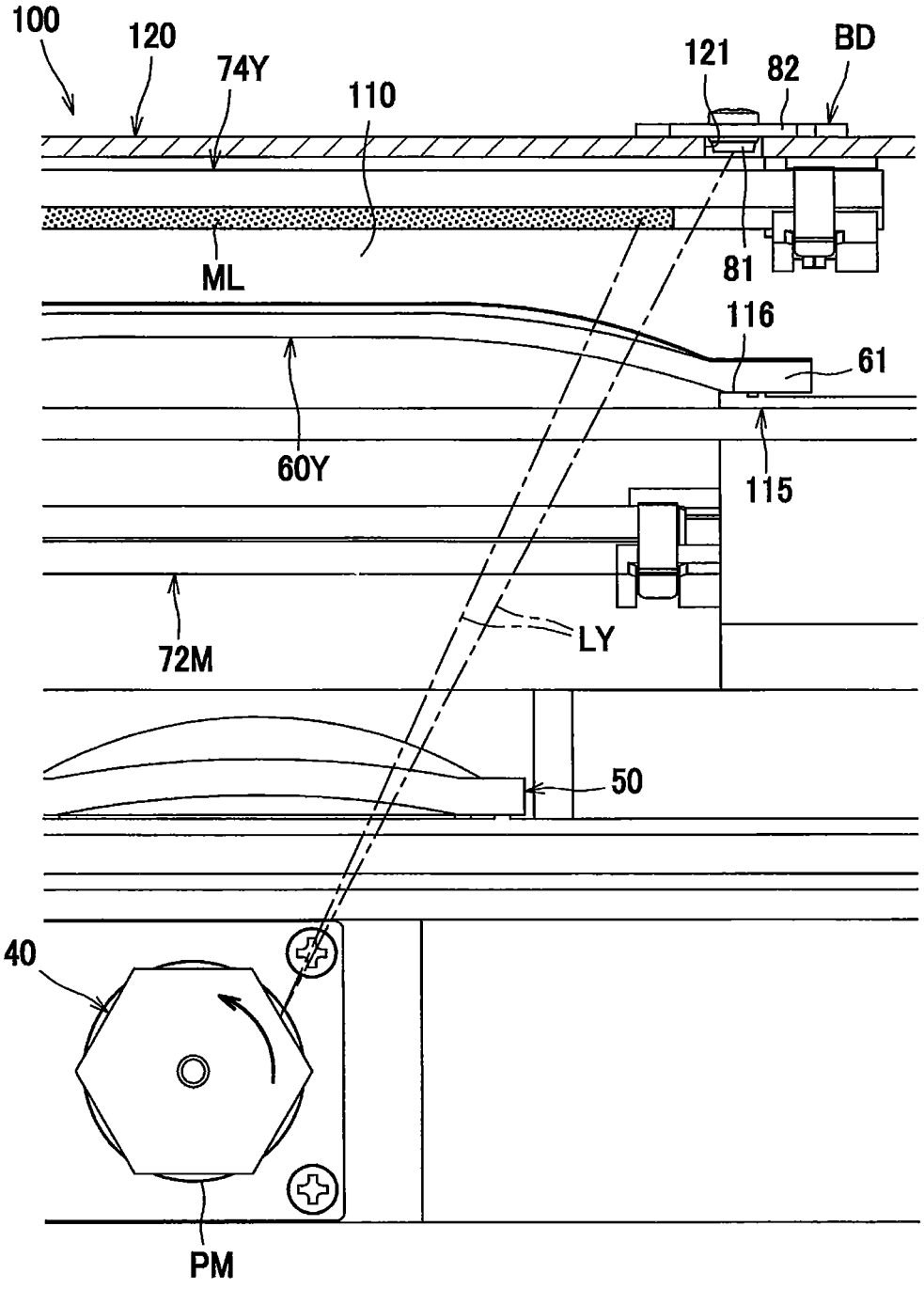
FIG. 4 is an enlarged plan view of the scanner unit according to the embodiment.

As illustrated in FIG. 4, only one writing sensor BD is provided in the scanner unit 1. The writing sensor BD mainly has a light receiving element 81 that detects the first beam LY and a circuit substrate 82 to which the light receiving element 81 is assembled. The writing sensor BD is mounted to the casing 100 from outside so as to cover an aperture 121 formed in the side wall 120 of the casing 100. As a result, the light receiving element 81 is disposed with its detection surface facing the inside of the casing 100.

When the receiving element 81 detects the first beam LY, the writing sensor BD outputs a detection signal indicating detection of the first beam LY to the control unit 300. Upon reception of the detection signal from the writing sensor BD, the control unit 300 determines a timing of emitting an exposing laser light from each of the light source devices 20. The exposing laser light refers to a laser light that is incident on the surface of the photosensitive drum 251 in accordance with image data. Further, the scanning exposure refers to the scanning of an area on the surface of the photosensitive drum 251 corresponding to the area of an image forming region on the paper sheet P, by focusing the laser light on the surface to form an image.

The reflecting mirror 74Y has a configuration in which an end portion thereof in the longitudinal direction can transmit the laser light LY. Specifically, in the reflecting mirror 74Y formed by depositing a material having high reflectance on the surface of a glass plate, a mirror layer ML (half-tone part in FIG. 4) is not formed at a part corresponding to the writing sensor BD. This allows the light receiving element 81 to detect the laser light LY passing through the end portion of the reflecting mirror 74Y. More specifically, the writing sensor BD is disposed upstream of the mirror layer ML in the scanning direction of the first beam LY.

The casing 100 is a member that accommodates therein the light source devices 20, the polygon mirror 40, the second cylindrical lenses 60, and the reflecting mirrors 71 to 75. The casing 100 mainly has a support wall 110 and the side walls 120 that protrude upward from the both end portions of the support wall 110 in the front-rear direction.

The support wall 110 is the lower wall of the casing 100 and supports the light source devices 20, the polygon mirror 40, the fθ lenses 50, the second cylindrical lenses 60Y and 60K, and the reflecting mirrors 72 and 74. As illustrated in FIG. 3, four exposure apertures 111 to 114 are formed in the support wall 110 so as to be arranged in the front-rear direction. The laser lights LY to LK reflected by the reflecting mirrors 73 and 75 to be directed toward the surfaces of the respective photosensitive drums 251 pass through the four exposure apertures 111 to 114, respectively.

As illustrated in FIG. 1, the control unit 300 is provided inside the main body casing 210 and mainly includes a CPU, a memory 310 serving as a storage unit having a RAM or a ROM, and an input/output circuit. The control unit 300 is connected to the scanner unit 1 and configured to control the light source devices 20 and polygon motor PM of the scanner unit 1 on the basis of a signal from the writing sensor BD of the scanner unit 1 or the program or data stored in the memory 310.

Figure 5A:
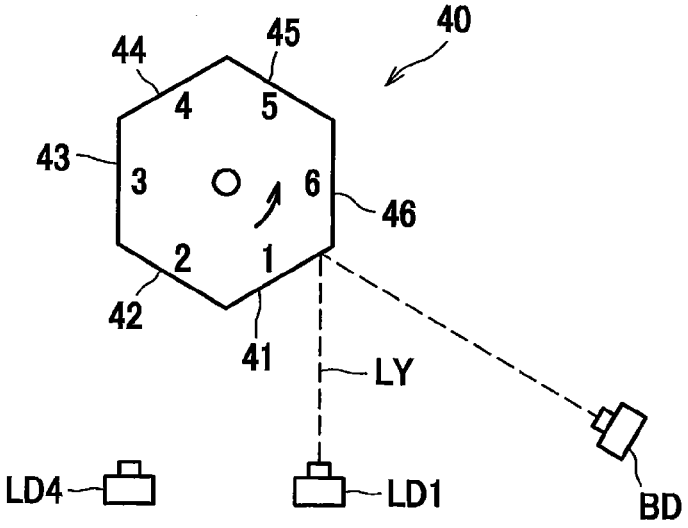
FIG. 5A illustrates a state where a first beam is detected by a writing sensor according to the embodiment.
Figure 5B:
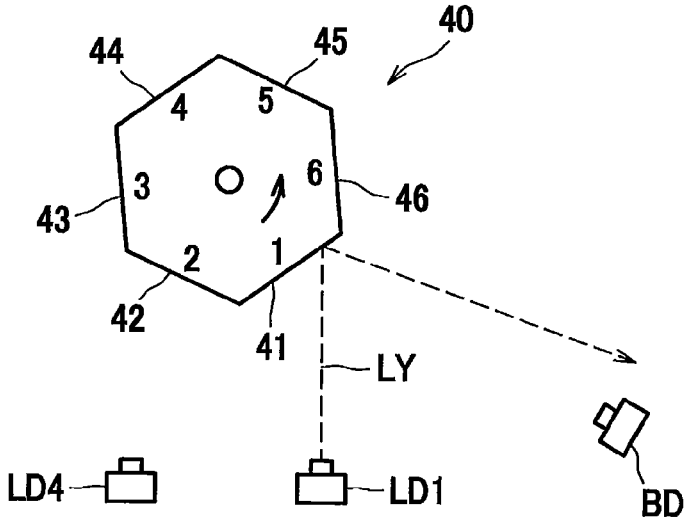
FIG. 5B illustrates a starting state of scanning exposure using the first beam according to the embodiment.

As illustrated in FIGS. 5A and 5B, after elapse of a first time Tf (see FIG. 9) from acquisition of a detection signal indicating the first beam LY deflected by the predetermined mirror surface of the polygon mirror 40, the control unit 300 starts scanning exposure by the first beams LY and LM using the predetermined mirror surface. The numerals "1", "2", . . . , "6" shown in FIG. 5 correspond respectively to the first mirror surface 41, the second mirror surface 42, . . . , the sixth mirror surface 46. The first time Tf is an example of a first time period.

More specifically, during a time from when the first beam LY is emitted toward a predetermined mirror surface to when the first beam LY goes off from the predetermined mirror, the first beam LY reflected by the predetermined mirror surface is detected using the writing sensor BD, and scanning exposure by the first beam LY is performed. The first time Tf is set to a time from when the first beam LY reaches the writing sensor BD to when the first beam LY reaches image forming regions of corresponding one of the photosensitive drums 251Y and 251M in the first scanning optical system SC1. The first time Tf is a fixed value previously set by experiments or simulations.

Specifically, when detecting the first beam LY deflected by, e.g., the first mirror surface 41 is detected using the writing sensor BD, the control unit 300 starts scanning exposure by the first beams LY and LM deflected by the first mirror surface 41 after elapse of the first time Tf from when the first beam LY is detected (reference time ty). Similarly, the control unit 300 performs the above-mentioned operation at other mirror surfaces 42 to 46. That is, the control unit 300 uses the same mirror surface to perform detection of the first beam LY using the writing sensor BD and to perform scanning exposure by the first beams LY and LM.

Figure 5C:
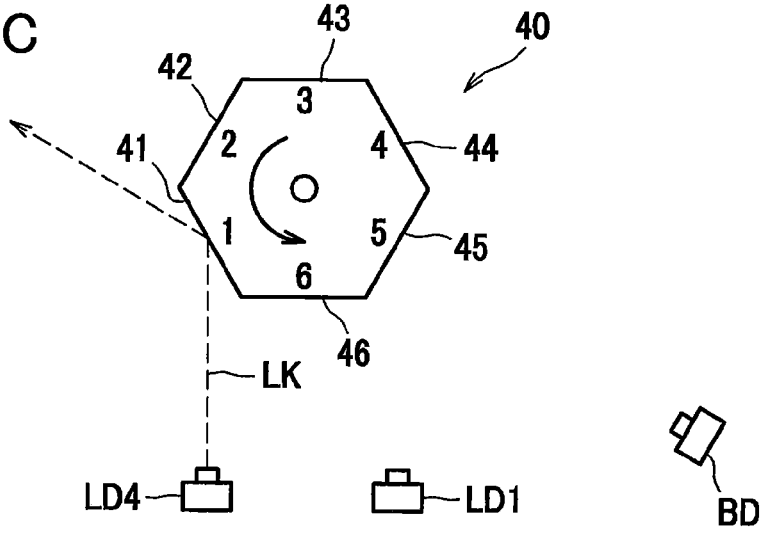
FIG. 5C illustrates the starting state of scanning exposure using a second beam according to the embodiment.

Further, as illustrated in FIGS. 5A and 5C, after elapse of a second time Ts (see FIG. 9) from acquisition of the detection signal of the first beam LY deflected by the predetermined mirror surface of the polygon mirror 40, the control unit 300 starts scanning exposure by the second beams LC and LK deflected by the predetermined mirror surface. Here, the second time Ts is larger than the first time Tf. More specifically, during a time after the first beam LY deflected by the predetermined mirror surface is detected by the writing sensor BD and before one rotation of the polygon mirror 40, the control unit 300 starts scanning exposure with the second beams LC and LK deflected by the predetermined mirror surface. The second time Ts is an example of a second time period.

Specifically, for example, when the first beam LY deflected by the first mirror surface 41 is detected by the writing sensor BD, the control unit 300 starts scanning exposure with the second beams LC and LK deflected by the first mirror surface 41 after elapse of the second time Ts from when the first beam LY is detected (reference time ty). Similarly, the control unit 300 performs the above-mentioned operation at other mirror surfaces 42 to 46. That is, the control unit 300 uses the same mirror surface to perform the detection of the first beam LY using the writing sensor BD and the scanning exposure by the second beams LC and LK.

The control unit 300 calculates the above second time Ts on the basis of the detection signal outputted from the writing sensor BD.

The control unit 300 has an unillustrated clock. The clock measures a time by counting up the number every predetermined unit time. The unit time may be set to, e.g., a time (sec) corresponding to 4800 dpi (dots per inch).

The control unit 300 calculates and acquires a detection interval Tmsr corresponding to one rotation of the polygon mirror 40. Specifically, the control unit 300 acquires, as the detection time interval Tmsr, a time period from the acquisition of a detection signal corresponding to a predetermined mirror surface until the acquisition of the detection signal corresponding to the predetermined mirror surface after one rotation of the polygon mirror 40. The detection signal corresponding to a predetermined mirror surface refers to a detection signal outputted from the writing sensor BD when the first beam LY reflected by the predetermined mirror surface is detected using the writing sensor BD. The control unit 300 calculates the second time Ts on the basis of the acquired detection interval Tmsr.

More specifically, the control unit 300 calculates a correction value adj on the basis of the following expression (1) and then calculates the second time Ts on the basis of the following expression (2):

$$adj=(Tmsr-Ttrg)\times 5/6 \ldots \quad (1)$$

$$Ts=Ws+adj \ldots \quad (2),$$

where Ttrg is an ideal value (reference value) of the detection interval corresponding to one rotation of the polygon mirror 40, and Ws is an ideal value of the second time corresponding to the ideal value Ttrg.

Each of the ideal values Ttrg and Ws is a fixed value predetermined by experiments or simulations when there is no fluctuation in the rotation speed of the polygon mirror 40. Further, in the expression (1), the second time Ts substantially corresponds to a time during which the polygon mirror 40 is rotated by 300 degrees (5/6 revolutions), so that 5/6 is used as a constant for multiplication.

According to the above expressions (1) and (2), when the detection interval Tmsr is different from the ideal value Ttrg, the control unit 300 sets the second time Ts to a value different from the ideal value Ws. More specifically, when the detection interval Tmsr is larger than the ideal value Ttrg, the control unit 300 sets the second time Ts to a value larger than the ideal value Ws. When the detection interval Tmsr is equal to the ideal value Ttrg, the control unit 300 sets the second time Ts to the ideal value Ws. When the detection interval Tmsr is smaller than the ideal value Ttrg, the control unit 300 sets the second time Ts to a value smaller than the ideal value Ws.

Further, the control unit 300 calculates the above second time Ts every time it acquires the detection signal. Then, when performing scanning exposure by the second beams LC and LK at a predetermined mirror surface, the control unit 300 uses the latest second time Ts to start the scanning exposure. More specifically, the control unit 300 performs the scanning exposure by the second beams LC and LK at a predetermined mirror surface by using the second time Ts calculated on the basis of the detection interval Tmsr acquired immediately before the start of the scanning exposure.

In other words, the control unit 300 acquires the detection interval Tmsr on the basis of the detection signal corresponding to a mirror surface downstream of the predetermined mirror surface in the rotation direction, calculates the second time Ts on the basis of the detection interval Tmsr, and starts the scanning exposure with the second beams LC and LK using the predetermined mirror surface. Specifically, for example, when scanning exposure with the second beams LC and LK is performed using the first mirror surface 41, the control unit 300 detects the first light beam LY reflected by the first mirror surface 41, and then acquires the detection interval Tmsr on the basis of the detection signal corresponding to the fifth mirror surface (see FIG. 5C) positioned downstream of the first mirror surface 41 in the rotation direction. Next, the control unit 300 calculates the second time Ts on the basis of the acquired detection interval Tmsr, and starts the scanning exposure.

The following describes operations of the control unit 300 in detail. The control unit 300 repeatedly executes the processing of the flowchart of FIG. 6.

Figure 6:
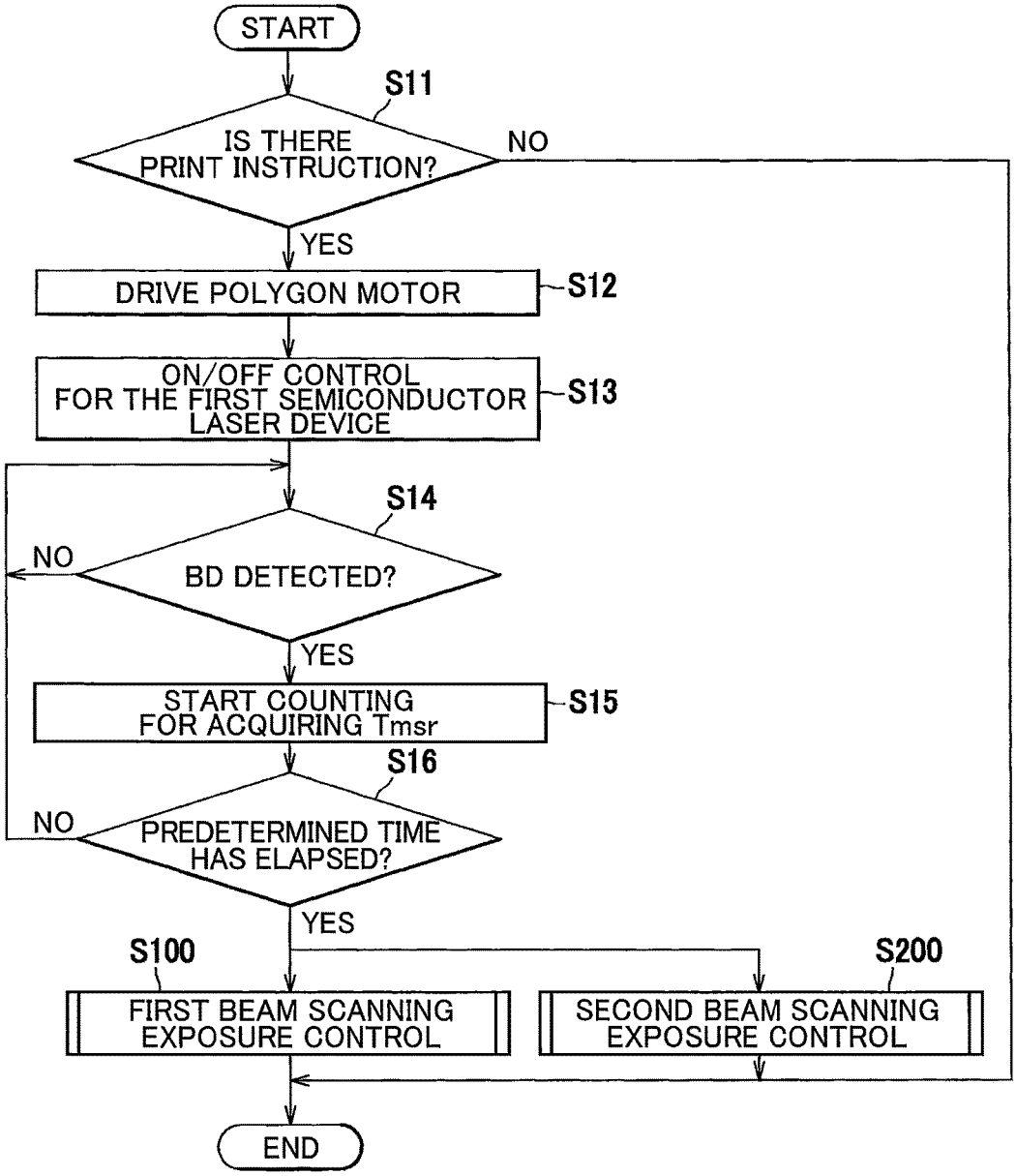
FIG. 6 is a flowchart indicating processing of a control unit according to the embodiment.

As illustrated in FIG. 6, the control unit 300 determines whether or not there is a print instruction (S11). When determining in step S11 that there is no print instruction (No), the control unit 300 ends this processing.

When determining in step S11 that there is a print instruction (Yes), the control unit 300 drives the polygon motor PM (S12) to rotate the polygon mirror 40. After step S12, when the rotation speed of the polygon mirror 40 reaches a target value, that is, when the rotation of the polygon mirror 40 becomes stable, the control unit 300 starts ON/OFF control for the first semiconductor laser device LD1 (S13). The control unit 300 performs control to maintain the rotation speed of the polygon mirror 40 at the target value on the basis of a detection result from a speed detection unit such as a hall element provided in the polygon motor PM. At this time, the rotation speed of the polygon mirror 40 may be fluctuated by disturbance or an error in the accuracy of the polygon mirror 40.

The ON/OFF control for the first semiconductor laser device LD1 in step S13 is control of emitting the first beam LY to the writing sensor BD at a constant period. For example, in the ON/OFF control, the control unit 300 turns ON the first semiconductor laser device LD1 and then determines whether or not the first beam LY has been detected by the writing sensor BD. When determining that the first beam LY has been detected, the control unit 300 turns OFF the first semiconductor laser device LD1 during a first specified time. The first specified time is set to a value slightly smaller than a time corresponding to one rotation of the polygon mirror 40. After elapse of the first specified time from the detection of the first beam LY, the control unit 300 turns ON the first beam LY. Thereafter, the control unit 300 repeats this operation to acquire the detection signal corresponding to each mirror surface. The ON/OFF control is executed from step S13 to the end of scanning exposure control to be described later.

After step S13, the control unit 300 determines whether or not the detection signal has been acquired from the writing sensor BD (S14). When determining in step S14 that the detection signal has not been acquired (No), the control unit 300 repeats step S14. When determining in step S14 that the detection signal has been acquired (Yes), the control unit 300 starts counting from the time at which the detection signal is acquired so as to acquire the detection interval Tmsr (S15). More specifically, for example, when detecting the first beam LY reflected by the fifth mirror surface 45 in step S14, the control unit 300 starts counting in step S15 from the time at which the first beam LY is detected so as to acquire the detection interval Tmsr corresponding to the fifth mirror surface 45.

The control unit 300 continues the counting for the fifth mirror surface 45 until the next time the detection signal corresponding to the fifth mirror surface 45 is received. The control unit 300 acquires the counted time (the number of counts) as the detection interval Tmsr corresponding to the fifth mirror surface 45, when the next detection signal is received. Further, when receiving the next detection signal, the control unit 300 resets the counted time and starts the counting for the fifth mirror surface 45 once again. The control unit 300 performs this operation for other mirror surfaces in the same manner. As a result, the control unit 300 acquires the detection intervals Tmsr corresponding to the respective mirror surfaces.

After step S15, the control unit 300 determines whether or not a predetermined time has elapsed (S16). The predetermined time may be a time during which the detection interval Tmsr required to calculate the second time Ts used for the first time in second beam scanning exposure control to be described later can be obtained.

When determining in step S16 that the predetermined time has not elapsed (No), the control unit 300 returns to step S14. When determining in step S16 that the predetermined time has elapsed (Yes), the control unit 300 simultaneously executes first beam scanning exposure control (S100) of FIG. 7 and second beam scanning exposure control (S200) of FIG. 8.

Figure 7:
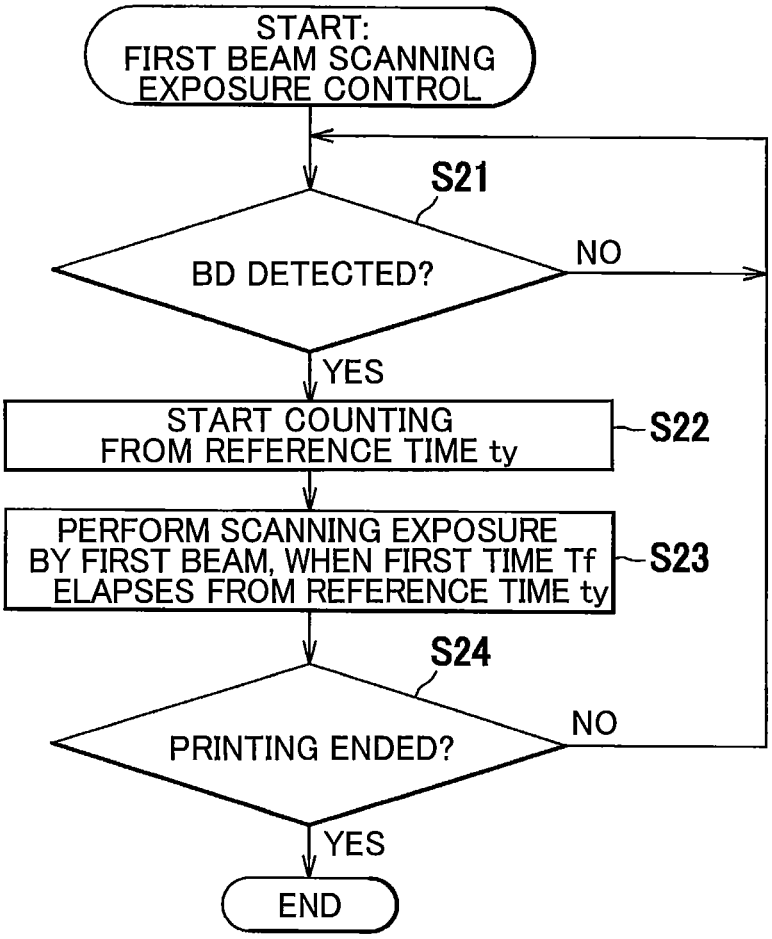
FIG. 7 is a flowchart indicating scanning exposure control with the first beam performed by the control unit according to the embodiment.

As illustrated in FIG. 7, in the first beam scanning exposure control, the control unit 300 determines whether or not the detection signal has been acquired from the writing sensor BD (S21). When determining in step S21 that the detection signal has not been acquired from the writing sensor BD (No), the control unit 300 repeats step S21. When determining in step S21 that the detection signal has been acquired from the writing sensor BD (Yes), the control unit 300 starts counting with the time at which the detection signal is acquired set as the reference time ty (S22). More specifically, in step S22, the control unit 300 starts counting using a first counter for measuring the first time Tf and, at the same time, starts counting using a second counter for measuring the second time Ts. The number of counts acquired by the first counter is reset by the control unit 300 when the control unit 300 acquired the next detection signal, and then counting is started from the beginning. The number of counts acquired by the second counter is reset by the control unit 300 when the control unit 300 ends the scanning exposure with the second beams LC and LK, and then counting is started from the beginning.

After step S22, when the first time Tf has elapsed from the reference time ty, that is, when the number of counts acquired by the first counter becomes equal to or larger than a value corresponding to the first time Tf, the control unit 300 controls the first semiconductor laser devices LD1 and LD2 according to image data to perform the scanning exposure with the first beams LY and LM (S23). After step 23, the control unit 300 determines whether or not the print control has been ended (S24).

When determining in step S24 that the print control has not been ended (No), the control unit 300 returns to step S21. When determining in step S24 that the print control has been ended (Yes), the control unit 300 ends this processing.

Figure 8:
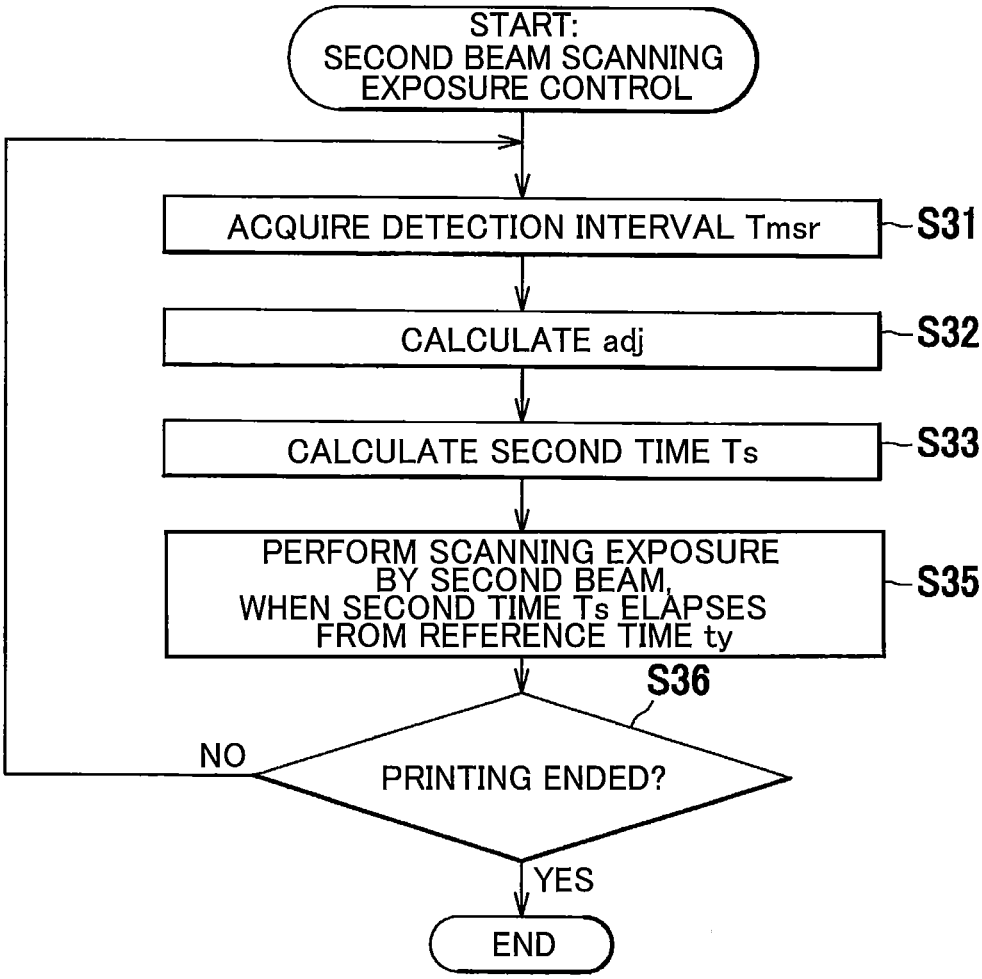
FIG. 8 is a flowchart indicating scanning exposure control with the second beam performed by the control unit according to the embodiment.

As illustrated in FIG. 8, in the second beam scanning exposure control, the control unit 300 starts counting from the time at which the detection signal corresponding to a predetermined mirror surface is acquired. The control unit 300 acquires the detection interval Tmsr which is the time until the detection signal corresponding to the predetermined mirror surface is acquired after one rotation of the polygon mirror 40 (S31). For example, the control unit 300 acquires, as the detection interval Tmsr, a time counted from when the first beam LY reflected by the fifth mirror surface 45 is detected in step S14 to when the first beam LY reflected by the fifth mirror surface 45 is detected in step S21. After step S31, the control unit 300 calculates the correction value adj on the basis of the detection interval Tmsr and above expression (1) (S32).

After step S32, the control unit 300 calculates the second time Ts on the basis of the correction value adj and above expression (2) (S33). After step S33, when the second time Ts has elapsed from the reference time ty, that is, when the number of counts acquired by the second counter becomes equal to or larger than a value corresponding to the second time Ts, the control unit 300 controls the second semiconductor laser devices LD3 and LD4 based on image data to perform the scanning exposure with the second beams LC and LK (S35). After step S35, the control unit 300 determines whether or not the print control has been ended (S36).

When determining in step S36 that the print control has not been ended (No), the control unit 300 returns to step S31. When determining in step S36 that the print control has been ended (Yes), the control unit 300 ends this routine.

Figure 9:
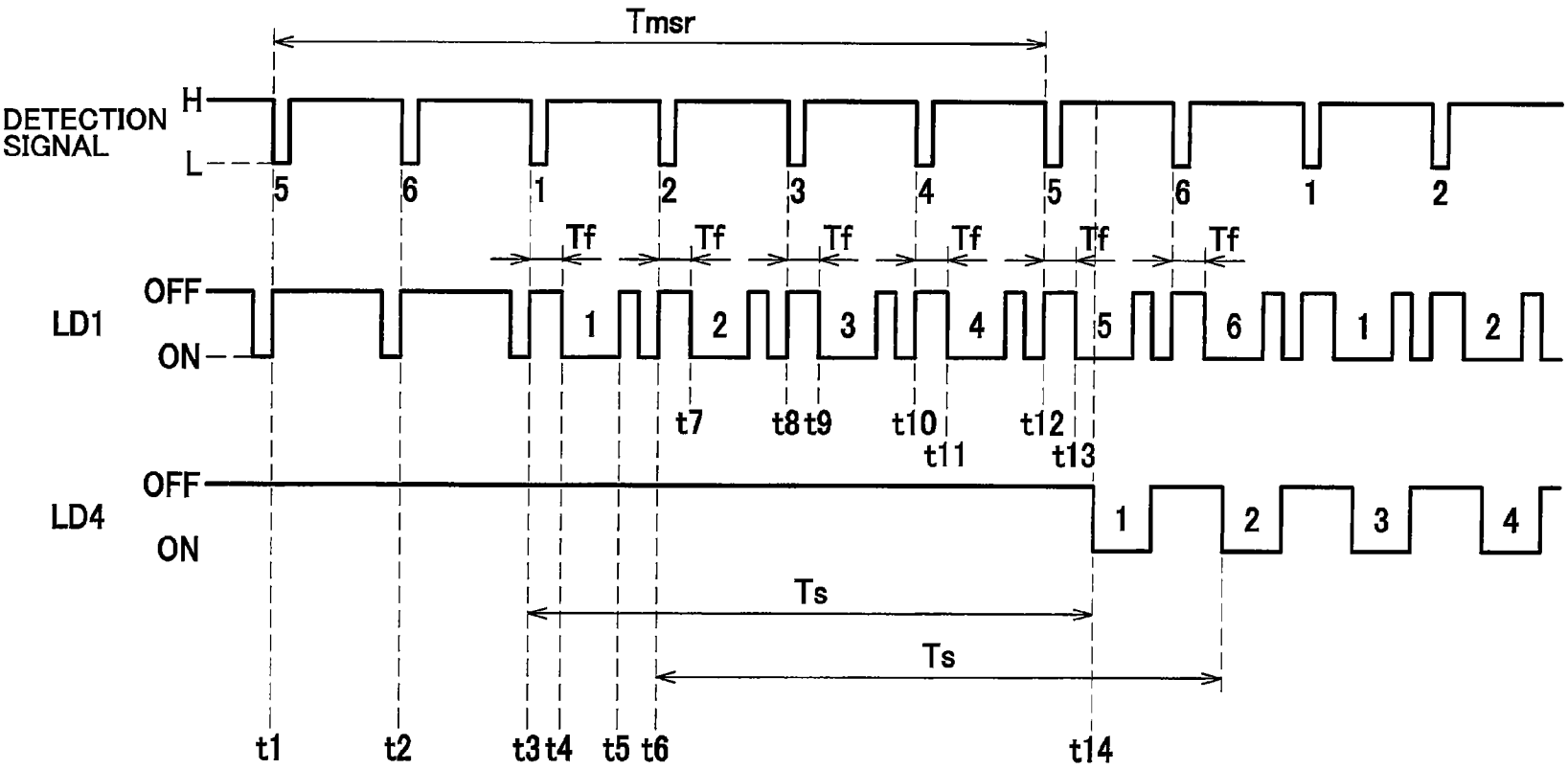
FIG. 9 is a time chart indicating an example of an operation performed by the control unit according to the embodiment.

The following describes in detail an example of the operation of the control unit 300 using the flowchart of FIG. 9. Hereinafter, descriptions of the first semiconductor laser device LD2 for magenta and the second semiconductor laser device LD3 for cyan which are subjected to substantially the same control as those for the first semiconductor laser device LD1 for yellow and the second semiconductor laser device LD4 for black, respectively, will be omitted.

As illustrated in FIG. 9, the control unit 300 rotates the polygon mirror 40 in response to a print instruction and, when the rotation speed of the polygon mirror 40 reaches a target value, starts ON/OFF control for the first semiconductor laser device LD1. As a result, the detection signals corresponding to the respective mirror surfaces are outputted, and thus the control unit 300 acquires a plurality of detection signals (time t1 and time t2) before the start (time t3) of the scanning exposure with the first beam LY. In the present embodiment, the output level of the writing sensor BD is changed from H level to L level when the writing sensor BD detects the first beam LY. However, the present disclosure is not limited to this, and the output level of the writing sensor BD is changed from L level to H level upon detection of the first beam LY.

When a predetermined time has elapsed from the start of the ON/OFF control for the first semiconductor laser device LD1 (time t3), the control unit 300 starts the first beam scanning exposure control. In the present embodiment, the first scanning exposure of the first beam scanning exposure control is performed at the first mirror surface 41, followed by sequentially at the second mirror surface 42, the third mirror surface 43, the fourth mirror surface 44, . . . , the sixth mirror surface 46. The numerals "1", "2", . . . , "6" shown in FIG. 9 correspond respectively to the first mirror surface 41, the second mirror surface 42, . . . , the sixth mirror surface 46.

In the first beam scanning exposure control, when the first beam LY reflected by the first mirror surface 41 is detected by the writing sensor BD (time t3), the control unit 300 sets the reference time ty for writing the first and second beams LY and LK to time t3.

When the first time Tf has elapsed from the reference time ty (time t4), the control unit 300 performs scanning exposure with the first beam LY deflected by the first mirror surface 41 (time t4 to t5). Thereafter, the first beam LY reflected by the second mirror surface 42 is detected by the writing sensor BD (time t6), the control unit 300 sets time t6 as the reference time ty. That is, thereafter, the control unit 300 updates the reference time ty for writing the first beam LY every time it acquires the detection signal.

When the first time Tf has elapsed from the reference time ty (time t7), the control unit 300 performs scanning exposure by the first beam LY at the second mirror surface 42. Thereafter, the control unit 300 sequentially performs detection by the writing sensor BD (e.g., time t8, t10, t12) and scanning exposure (e.g., time t9, t11, t13) at the third mirror surface 43, the fourth mirror surface 44, the fifth mirror surface 45, the sixth mirror surface 46, and the first mirror surface 41, . . . , in this order.

On the other hand, in the second beam scanning exposure control, the control unit 300 starts counting from the time at which the detection signal corresponding to a predetermined mirror surface is acquired, acquires the detection interval Tmsr which is the time until the detection signal corresponding to the predetermined mirror surface is acquired after one rotation of the polygon mirror 40, and calculates the second time Ts on the basis of the detection interval Tmsr. Specifically, the control unit 300 starts counting after acquisition of the detection signal corresponding to the fifth mirror surface 45 at time t1. The control unit 300 acquires, as the detection interval Tmsr, the time until the detection signal corresponding to the fifth mirror surface 45 is acquired at time t12 and calculates the second time Ts on the basis of the detection interval Tmsr.

The control unit 300 determines whether or not the second time Ts has elapsed from the reference time ty set to time t3. When determining that the second time Ts has elapsed from the reference time ty, the control unit 300 performs scanning exposure by the second beam LK at the mirror surface 41 (time t14). In the present embodiment, the scanning exposure by the second beam LK is performed after time t12 at which the first beam LY reflected by the fifth mirror surface 45 is detected by the writing sensor BD. Accordingly, the second time Ts used for this scanning exposure is calculated on the basis of the detection interval Tmsr corresponding to the fifth mirror surface 45. That is, the detection interval Tmsr is acquired on the basis of the detection signal acquired at time t12, i.e., immediately before execution of the scanning exposure with the second beam LK, and the second time Ts is calculated on the basis of the acquired detection interval Tmsr.

After completion of the scanning exposure at the first mirror surface 41, the control unit 300 updates the reference time ty to a new reference time ty (time t6) that is corresponding to the second mirror surface 42 and the second beam LK. The control unit 300 performs the same operation as described above. That is, every time the scanning exposure is performed, the control unit 300 updates the reference time ty to a new reference time ty corresponding to the mirror surface used in the next scanning exposure, where the new reference time ty is referred to as a reference time used for writing by the second beam LK. Further, the control unit 300 updates the second time Ts every time the detection signal is acquired and starts scanning exposure after elapse of the latest second time Ts from the reference time ty.

According to the above embodiment, the following effects can be obtained.

When the rotation speed of the polygon motor PM is fluctuated, the detection interval Tmsr corresponding to one rotation of the polygon mirror 40 deviates from the ideal value Ttrg. To solve this problem, the second time Ts is calculated on the basis of the detection interval Tmsr corresponding to one rotation of the polygon mirror. As a result, influence on the fluctuation in the rotation speed can be suppressed to thereby allow the second beams LC and LK to be written at an appropriate timing. Further, the scanning exposure with the first beams LY and LM and scanning exposure with the second beams LC and LK are performed at the same mirror surface, so that there is no influence of the surface division accuracy of the polygon mirror.

By calculating and acquiring the detection interval Tmsr on the basis of the detection signal corresponding to the fifth mirror surface 45 downstream of the first mirror surface 41 in the rotation direction, the second time Ts can be calculated on the basis of the detection interval Tmsr corresponding to a rotation speed close to that immediately before execution of the scanning exposure by the second beams LC and LK, so that the second beams LC and LK can be written at an appropriated timing.

The present disclosure is not limited to the above embodiment, but may be variously modified as exemplified below.

In the above embodiment, the second time Ts used for the scanning exposure by the second beam LK at the first mirror surface 41 is calculated by calculating and acquiring the detection interval Tmsr on the basis of the detection signal corresponding to the fifth mirror surface 45; however, the present disclosure is not limited to this embodiment. For example, the second time Ts used for the scanning exposure at the first mirror surface 41 may be calculated on the basis of the detection interval Tmsr obtained by calculation based on the detection signal corresponding to the first mirror surface 41 of the polygon mirror 40. More specifically, with reference to FIG. 9, the detection interval Tmsr is calculated on the basis of the detection signal obtained at the reference time ty (t3) used for the scanning exposure by the first beam LY at the first mirror surface 41 and the detection signal (time before time t1) corresponding to the first mirror surface 41 acquired before execution of the scanning exposure and, based on the acquired detection interval Tmsr, the second time Ts used for the scanning exposure with the second beam LK at the first mirror surface 41 is calculated. That is, in place of using the latest second time Ts, the second time Ts calculated five times before may be used for the scanning exposure by the second beam LK at the first mirror surface 41.

With the above configuration, the detection interval Tmsr corresponding to the rotation speed at the time point when the first beam LY reflected by the first mirror surface 41 enters the writing sensor BD can be acquired, whereby the second time Ts can be appropriately calculated on the basis of the detection interval Tmsr.

In the above embodiment, the second time Ts is calculated on the basis of one detection interval Tmsr and expressions (1) and (2); however, the present disclosure is not limited to this. For example, the control unit 300 may calculate the second time Ts on the basis of the average value of a plurality of detection intervals Tmsr. That is, the average value of the plurality of detection intervals Tmsr is substituted in the expression (1) to calculate the correction value adj, and the calculated correction value adj is substituted in the expression (2) to thereby calculate the second time Ts.

With the above configuration, the second beams LC and LK can be written at an appropriate timing according to long-period fluctuation in the rotation speed of the polygon motor PM.

In the above configuration, the control unit 300 may calculate the second time Ts by adding a larger weight to the detection interval Tmsr acquired later than the plurality of detection intervals Tmsr to be averaged. Specifically, when, for example, three detection intervals Tmsr are subjected to weighted average, coefficients of 0.5, 0.3, and 0.2 are multiplied respectively to the three detection intervals Tmsr in the order of late acquisition time, followed by summation of the multiplication results.

Thus, a larger weight can be added to the detection interval Tmsr close to the writing timing of the second beams LC and LK, whereby the second beams LC and LK can be written at an appropriate timing.

The control unit 300 may control the rotation speed of the polygon motor PM on the basis of the detection signal.

In the above embodiment, the polygon mirror 40 has a hexagonal shape; however, the present disclosure is not limited to this. The polygon mirror 40 may have other polygonal shapes such as a quadrilateral and an octagon.

In the above embodiment, the photosensitive drum 251 is used as a photosensitive body; however, the present disclosure is not limited to this. For example, a belt-like photosensitive body may be used.

In the above embodiment, the present disclosure is applied to the color printer 200; however, the present disclosure is not limited to this. The present disclosure may be applied to other image forming apparatuses such as a copying machine and a multifunction machine.

The following describes an example of the above embodiment. In this example, a deviation amount of the writing position of the second beam LK from a normal position is calculated using a spreadsheet program. The deviation amount is calculated regarding the cases where the second time Ts is not corrected and where the second time Ts is corrected using the same method as that used in the above embodiment. When the second time Ts is not corrected, it is set to the ideal value Ttrg used in the above embodiment.

Figure 10:
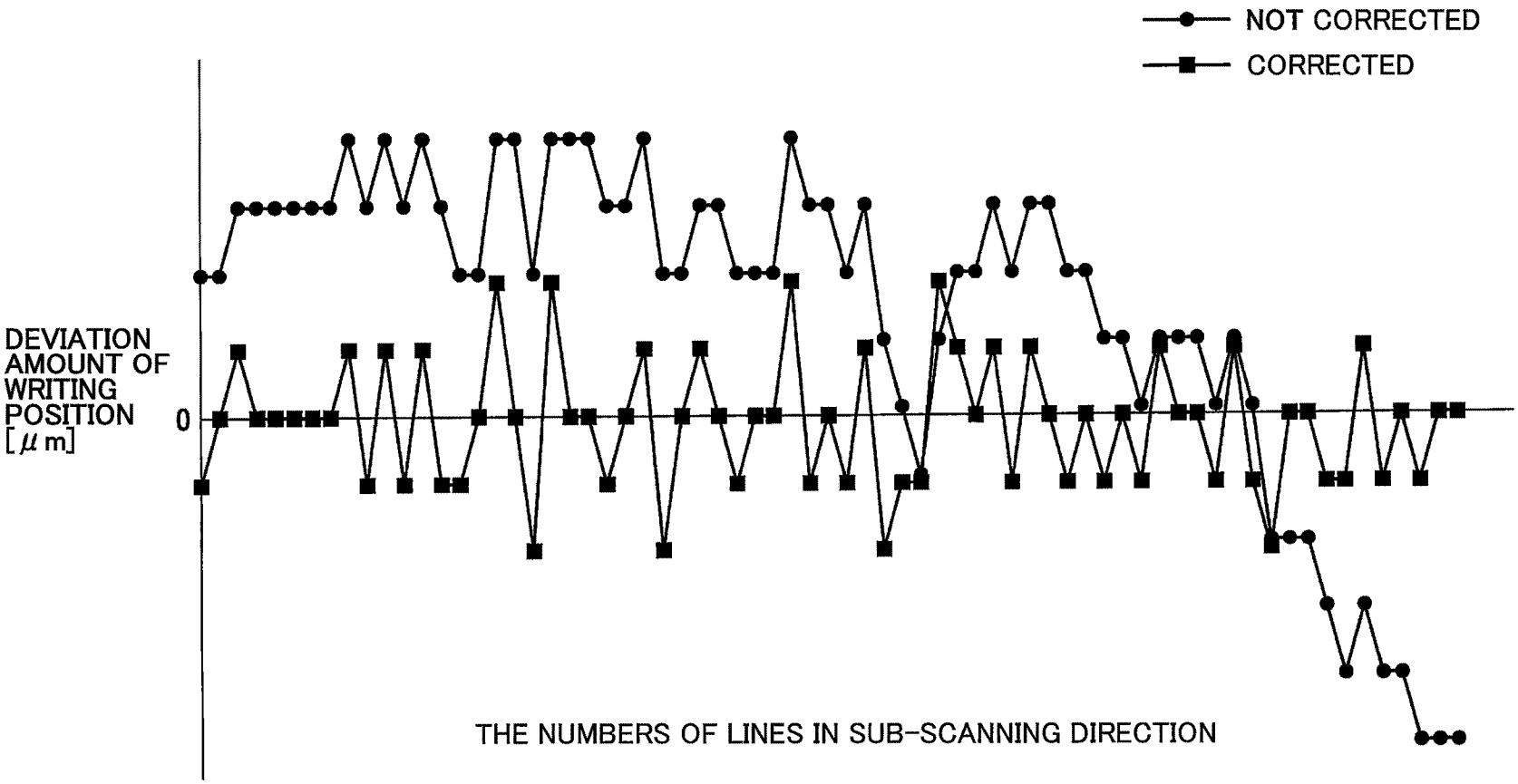
FIG. 10 is a graph illustrating the embodiment.

The results are illustrated in FIG. 10. As can be seen from FIG. 10, the deviation amounts were found to be close to 0 more concentratedly when the second time Ts is corrected than when the second time Ts is not corrected. Thus, it is found that the writing position of the second beam LK is more unlikely to deviate from a normal position when the second time Ts is corrected than when the second time Ts is not corrected.

While the description has been made in detail with reference to specific embodiments thereof, it would be apparent to those skilled in the art that various changes and modifications may be made therein without departing from the spirit and scope of the above described embodiments.

What is claimed is:

1. An image forming apparatus comprising:

a first light source configured to emit a first beam;

a second light source configured to emit a second beam;

a polygon mirror configured to deflect the first beam and the second beam and having a first mirror surface;

a motor configured to rotate the polygon mirror about a rotation axis;

a first scanning optical system configured to focus the first beam deflected by the polygon mirror on a first photosensitive body, the first scanning optical system defining a scanning direction;

an optical sensor disposed upstream of the first scanning optical system in the scanning direction and configured to detect the first beam deflected by the polygon mirror to output a detection signal in response to the detection;

a second scanning optical system disposed opposite to the first scanning optical system with respect to the rotation axis and configured to focus the second beam deflected by the polygon mirror on a second photosensitive body; and a controller configured to perform:

acquiring a detection interval of the detection signal during which the polygon mirror makes one rotation;

in response to elapse of a first time period after the detection signal has been detected, starting scanning exposure with the first beam deflected by the first mirror surface; and in response to elapse of a second time period after the detection signal has been detected, starting scanning exposure with the second beam deflected by the first mirror surface, the second time period being calculated based on the detection interval.

2. The image forming apparatus according to claim 1, wherein the controller is further configured to perform:

acquiring, in the acquiring, the detection interval based on the detection signal corresponding to the first mirror surface; and in the scanning exposure with the second beam, calculating the second time period based on the detection interval and starting the scanning exposure by the second beam deflected by the first mirror surface.

3. The image forming apparatus according to claim 1, wherein the polygon mirror is configured to rotate in a rotating direction and further has a second mirror surface downstream of the first mirror surface in the rotating direction; and wherein the controller is further configured to perform:

acquiring, in the acquiring, the detection interval based on the detection signal corresponding to the second mirror surface; and in the scanning exposure with the second beam, calculating the second time period based on the detection interval and starting the scanning exposure with the second beam deflected by the first mirror surface.

4. The image forming apparatus according to claim 1, wherein, in the starting of the scanning exposure with the second beam, the controller is further configured to perform calculating the second time period based on a plurality of detection intervals.

5. The image forming apparatus according to claim 4, wherein the controller is further configured to perform calculating the second time period by assigning weight values to the plurality of detection intervals, where the weight values are larger when the plurality of detection intervals are acquired later.

6. The image forming apparatus according to claim 1, wherein the motor is further configured to rotate in a rotation speed; and wherein the controller is further configured to perform controlling the rotation speed based on the detection signal.

7. A method for controlling an image forming apparatus, the image forming apparatus comprising:

a first light source configured to emit a first beam;

a second light source configured to emit a second beam;

a polygon mirror configured to deflect the first beam and the second beam and having a first mirror surface;

a motor configured to rotate the polygon mirror about a rotation axis;

a first scanning optical system configured to focus the first beam deflected by the polygon mirror on a first photosensitive body, the first scanning optical system defining a scanning direction;

an optical sensor disposed upstream of the first scanning optical system in the scanning direction and configured to detect the first beam deflected by the polygon mirror to output a detection signal in response to the detection; and a second scanning optical system disposed opposite to the first scanning optical system with respect to the rotation axis and configured to focus the second beam deflected by the polygon mirror on a second photosensitive body; and the method comprising:

acquiring a detection interval of the detection signal during which the polygon mirror makes one rotation;

in response to elapse of a first time period after the detection signal has been detected, starting scanning exposure with the first beam deflected by the first mirror surface; and in response to elapse of a second time period after the detection signal has been detected, starting scanning exposure with the second beam deflected by the first mirror surface, the second time period being calculated based on the detection interval.

8. The method according to claim 7, further comprising:

acquiring, in the acquiring, the detection interval based on the detection signal corresponding to the first mirror surface; and in the scanning exposure with the second beam, calculating the second time period based on the detection interval and starting the scanning exposure by the second beam deflected by the first mirror surface.

9. The method according to claim 7, wherein the polygon mirror is configured to rotate in a rotating direction and further has a second mirror surface downstream of the first mirror surface in the rotating direction; and wherein the method further comprises:

acquiring, in the acquiring, the detection interval based on the detection signal corresponding to the second mirror surface; and in the scanning exposure with the second beam, calculating the second time period based on the detection interval and starting the scanning exposure with the second beam deflected by the first mirror surface.

10. The method according to claim 7, wherein, in the starting of the scanning exposure with the second beam, the method further comprises calculating the second time period based on a plurality of detection intervals.

11. The method according to claim 10, further comprising calculating the second time period by assigning weight values to the plurality of detection intervals, where the weight values are larger when the plurality of detection intervals are acquired later.

12. The method according to claim 7, wherein the motor is further configured to rotate in a rotation speed; and wherein the method further comprises controlling the rotation speed based on the detection signal.

* * * * *